US010276959B2

(12) United States Patent
Lehner et al.

(10) Patent No.: US 10,276,959 B2
(45) Date of Patent: Apr. 30, 2019

(54) CONTACT ELEMENT AND EQUIPPING ARRANGEMENT WITH SAID CONTACT ELEMENT

(71) Applicant: TE Connectivity Germany GmbH, Bensheim (DE)

(72) Inventors: Antonio Lehner, Nauheim (DE); Rolf Jetter, Darmstadt (DE); Erik Glombitza, Bensheim (DE); Uwe Bluemmel, Hemsbach (DE); Marcel Baltes, Floersheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/660,209

(22) Filed: Jul. 26, 2017

(65) Prior Publication Data

US 2017/0324184 A1 Nov. 9, 2017

Related U.S. Application Data

(63) Continuation of application No. PCT/EP2016/052001, filed on Jan. 29, 2016.

(30) Foreign Application Priority Data

Jan. 30, 2015 (DE) ..... 10 2015 201 635

(51) Int. Cl.
*H01R 4/18* (2006.01)
*H01R 13/11* (2006.01)
(Continued)

(52) U.S. Cl.
CPC ..... *H01R 13/17* (2013.01); *H01R 4/18* (2013.01); *H01R 4/185* (2013.01); *H01R 13/11* (2013.01);
(Continued)

(58) Field of Classification Search
CPC ..... H01R 13/11–13/115; H01R 13/17; H01R 13/245; H01R 13/508; H01R 13/6272; H01R 4/185; H01R 4/18; H01R 43/055
(Continued)

(56) References Cited

U.S. PATENT DOCUMENTS 5,073,132 A * 12/1991 Nottrott ..... H01R 13/055 29/863
5,188,545 A * 2/1993 Hass ..... H01R 13/11 439/851
(Continued)

FOREIGN PATENT DOCUMENTS

JP 201345566 A 3/2013
JP 2014222650 A 11/2014
(Continued)

OTHER PUBLICATIONS

German Office Action, dated Sep. 11, 2015, 3 pages.
(Continued)

*Primary Examiner* — Gary F Paumen
(74) *Attorney, Agent, or Firm* — Barley Snyder

(57) ABSTRACT

A contact for an electrical plug connector comprises a plug portion and a contact spring. The plug portion has an opening receiving a pin contact in an insertion direction. The contact spring is connected by at least one spring arm base to the plug portion and extends from the at least one spring arm base toward the opening in a direction opposite the insertion direction. The contact spring exerts a contact force on the pin contact perpendicular to the insertion direction.

17 Claims, 13 Drawing Sheets

(51) Int. Cl.

| | |
|---|---|
| ***H01R 13/17*** | (2006.01) |
| ***H01R 13/24*** | (2006.01) |
| ***H01R 13/508*** | (2006.01) |
| ***H01R 13/627*** | (2006.01) |
| ***H01R 43/055*** | (2006.01) |

(52) U.S. Cl.
CPC ..... *H01R 13/245* (2013.01); *H01R 13/508* (2013.01); *H01R 13/6272* (2013.01); *H01R 43/055* (2013.01)

(58) Field of Classification Search
USPC ..... 439/851–854
See application file for complete search history.

(56) References Cited

U.S. PATENT DOCUMENTS

| | | | | |
|---|---|---|---|---|
| 5,427,544 | A * | 6/1995 | Okabe | H01R 4/2466 439/395 |
| 5,681,190 | A * | 10/1997 | Childs | H01R 13/11 439/842 |
| 7,300,319 | B2 * | 11/2007 | Lutsch | H01R 4/185 439/845 |
| 7,717,759 | B2 * | 5/2010 | Ishigami | H01R 4/184 439/748 |
| 7,950,972 | B1 * | 5/2011 | Chen | H01R 13/111 439/852 |
| 8,251,759 | B2 * | 8/2012 | Matsunaga | H01R 4/185 439/877 |
| 9,011,189 | B2 * | 4/2015 | Tsukamoto | H01R 43/16 439/885 |
| 2001/0019925 | A1 * | 9/2001 | Heimueller | H01R 13/113 439/851 |
| 2005/0118891 | A1 * | 6/2005 | Chen | H01R 13/113 439/851 |
| 2007/0123093 | A1 | 5/2007 | Lutsch et al. | |
| 2010/0015863 | A1 * | 1/2010 | Sugiyama | H01R 13/113 439/851 |
| 2010/0029146 | A1 * | 2/2010 | Myer | H01R 13/113 439/852 |
| 2010/0035449 | A1 | 2/2010 | Nagafuchi | |
| 2014/0017960 | A1 * | 1/2014 | Friedhof | H01R 13/111 439/851 |
| 2014/0038473 | A1 * | 2/2014 | Kojima | H01R 13/111 439/851 |
| 2014/0220835 | A1 * | 8/2014 | Seipel | H01R 4/185 439/877 |
| 2015/0171546 | A1 * | 6/2015 | Kibushi | H01R 13/114 439/382 |

FOREIGN PATENT DOCUMENTS

| | | | |
|---|---|---|---|
| JP | 2014232701 | A | 12/2014 |
| WO | 2013015449 | A1 | 1/2013 |
| WO | 2014034419 | A1 | 3/2014 |
| WO | 2014199833 | A1 | 12/2014 |

OTHER PUBLICATIONS

PCT Written Opinion of the International Searching Authority and International Search Report, dated Jun. 28, 2016, 13 pages.
Abstract of WO2014199833, dated Dec. 18, 2014, 2 pages.
Abstract of JP2014232701, dated Dec. 11, 2014, 2 pages.
Chinese First Office Action, English translation, dated Aug. 2, 2018, 7 pages.
Abstract of JP2013045566A, dated Mar. 4, 2013, 1 page.
Abstract of JP2014222650A, dated Nov. 27, 2014, 1 page.

* cited by examiner

State of the Art

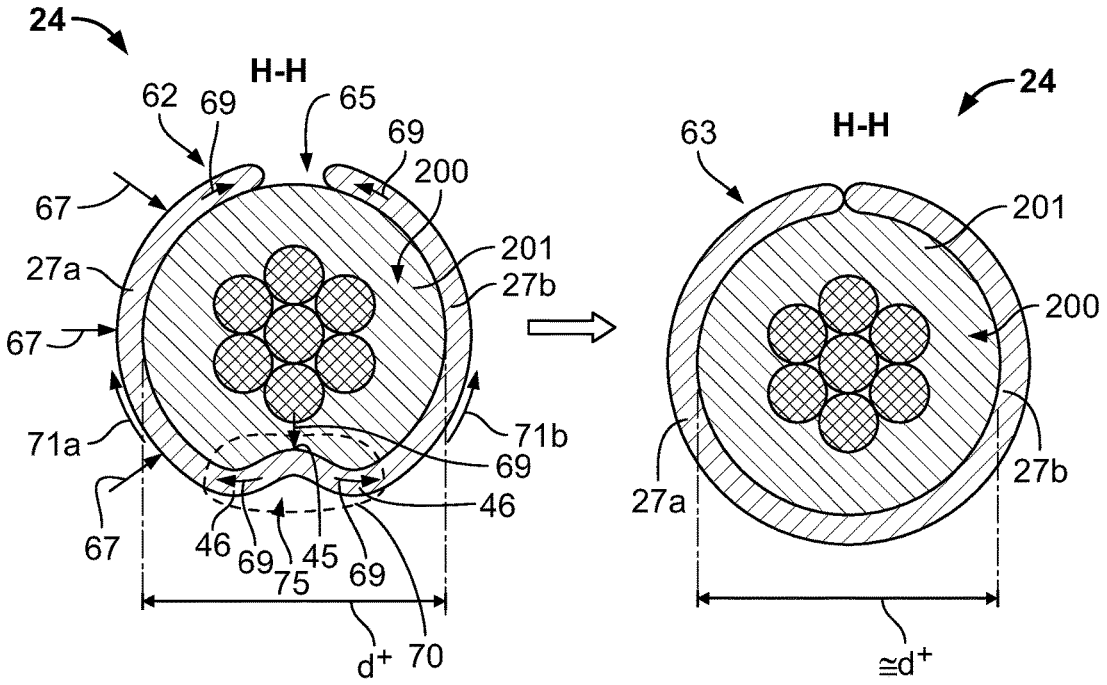
Fig. 19 (A) Fig. 19 (B)
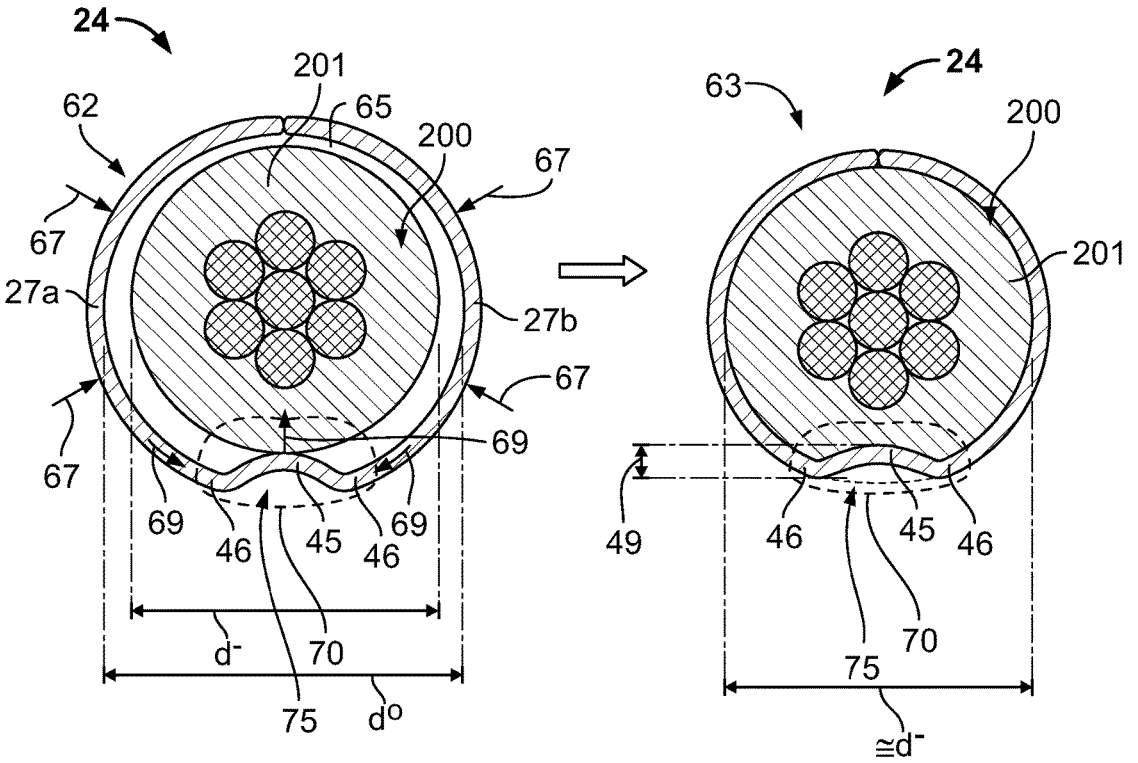
Fig. 20 (A) Fig. 20 (B)

CONTACT ELEMENT AND EQUIPPING ARRANGEMENT WITH SAID CONTACT ELEMENT

CROSS-REFERENCE TO RELATED APPLICATIONS

This application is a continuation of PCT International Application No. PCT/EP2016/052001, filed on Jan. 29, 2016, which claims priority under 35 U.S.C. § 119 to German Patent Application No. 102015201635.8, filed on Jan. 30, 2015.

FIELD OF THE INVENTION

The present invention relates to a contact and, more particularly, to a contact for an electrical plug connector.

BACKGROUND

Known plug contacts for plug connectors have a plug portion with an opening and a contact spring connected to the plug portion. A pin contact is inserted into the opening of the plug portion along an insertion direction. The contact spring exerts a contact force on the pin contact perpendicular to the insertion direction.

In the prior art, these known plug contacts have a material bridge connecting the plug contact to a carrier strip, which holds at least one plug contact. The plug contacts connected to the carrier strip are delivered in a folded state and loaded into automatic placement machines which provide the plug contacts automatically with electric conductors and/or insert them into plug connectors. There, the plug contacts receive the pin contacts in order to electrically connect the pin contacts to the electric conductors joined to the plug contacts.

The pin contacts must be held as reliably as possible in the plug contacts to maintain the electrical connection. There is an ongoing need to miniaturize plug connectors, as a result of which the plug contacts must also be reduced in size. However, ongoing reduction in size is made difficult due to the fact that the functional components of the plug contact, such as the contact spring, must still be accommodated on the plug portion and simultaneously must be able to apply the desired contact forces. Material thicknesses of metal sheets, from which the plug contacts and the carrier strips are generally punched out, are between 0.1 and 0.2 mm; despite this relatively thin sheet thickness, the plug contacts, produced for example from steel or phosphor bronze, must have the desired plug properties and contact forces.

SUMMARY

A contact for an electrical plug connector comprises a plug portion and a contact spring. The plug portion has an opening receiving a pin contact in an insertion direction. The contact spring is connected by at least one spring arm base to the plug portion and extends from the at least one spring arm base toward the opening in a direction opposite the insertion direction. The contact spring exerts a contact force on the pin contact perpendicular to the insertion direction.

BRIEF DESCRIPTION OF THE DRAWINGS

The invention will now be described by way of example with reference to the accompanying figures, of which:

FIG. 19A is a sectional view of an insulation crimp portion of the contact of FIG. 14 in a pre-crimp state with a large diameter insulation;

FIG. 19B is a sectional view of the insulation crimp portion of the contact of FIG. 14 in a final crimp state with the large diameter insulation;

FIG. 20A is a sectional view of the insulation crimp portion of the contact of FIG. 14 in a pre-crimp state with a small diameter insulation; and FIG. 20B is a sectional view of the insulation crimp portion of the contact of FIG. 14 in a final crimp state with the small diameter insulation.

DETAILED DESCRIPTION OF THE EMBODIMENTS

Figure 1:
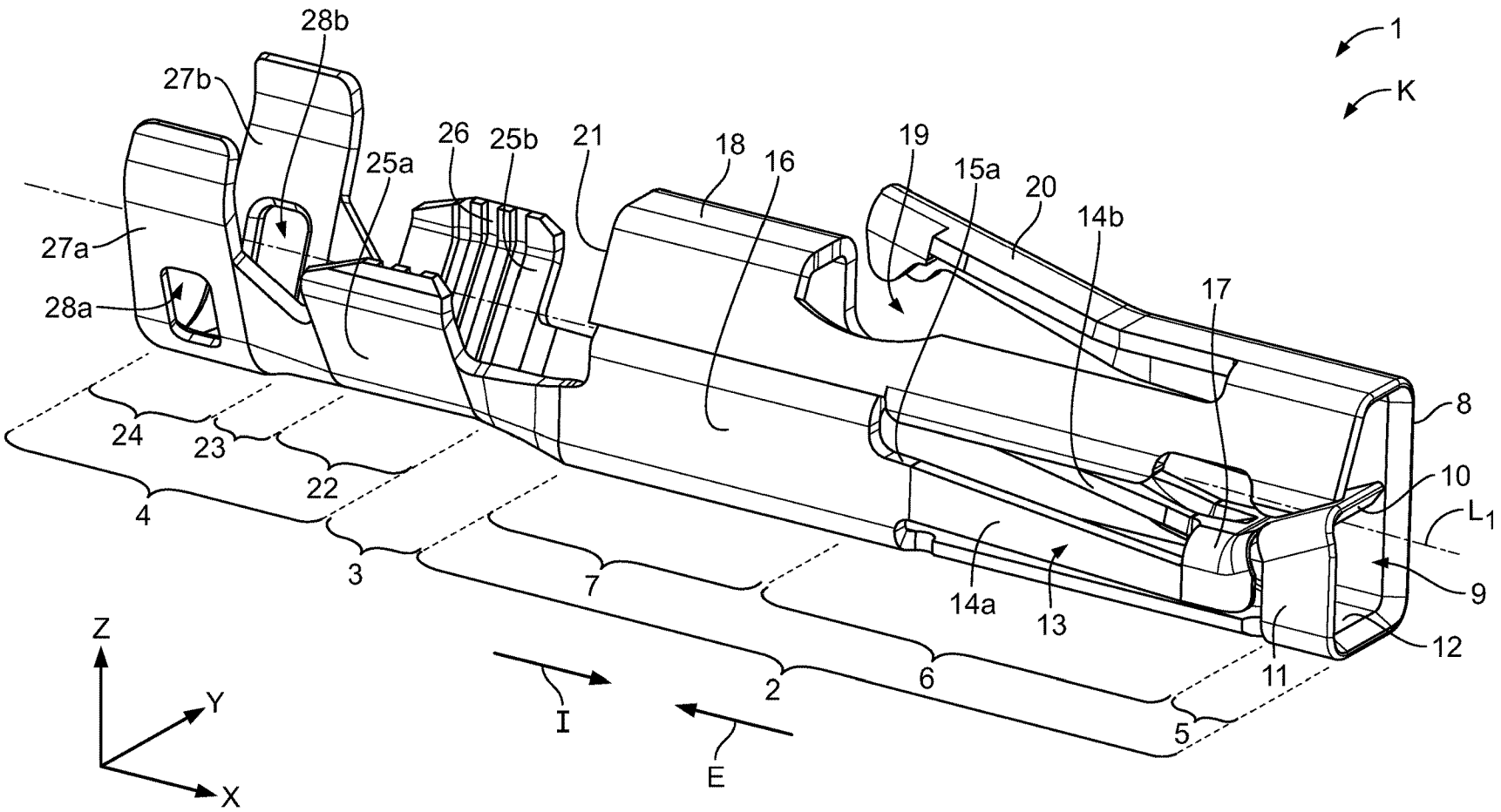
FIG. 1 is a perspective view of a contact according to the invention.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

A contact 1 according to the invention is shown in FIG. 1. In the shown embodiment, contact 1 is a plug contact. Contact 1 has a plug portion 2 connected via a transition portion 3 to a crimp portion 4.

Contact 1 extends with its longitudinal axis L1 in a longitudinal direction X and transversely to longitudinal axis L1 in a transverse direction Y and a vertical direction Z.

Longitudinal direction X, transverse direction Y and vertical direction Z jointly define a Cartesian coordinate system. All of the references to the front or rear in the description below refer to elements arranged or spaced apart relative to one another in or opposite to longitudinal direction X. References to left or right refer to elements arranged or spaced apart relative to one another in transverse direction Y. References to above or below refer to elements arranged or spaced apart relative to one another in or opposite to vertical direction Z.

Plug portion 2, as shown in FIG. 1, has an insertion portion 5, a contact portion 6 and a case portion 7.

Insertion portion 5 forms, in the region of a front edge 8 of contact 1, an opening 9. A pin contact (not shown) can be introduced in an insertion direction E through the opening 9 and into the plug portion 2 in order to electrically contact the contact portion 6. In order to guide the pin contact properly into the contact portion 6, insertion portion 5 has an insertion ramp 10 in the region of opening 9. The insertion ramp 10 is connected via a side wall 11 of contact 1 to a base 12 of contact 1.

Contact 1, as shown in FIG. 1, has a contact spring 13 in the contact portion 6. Contact spring 13 has spring arms 14*a*, 14*b* which are connected in each case via a spring arm base 15*a*, 15*b* to a housing 16 of contact 1 and support a free end 17 of contact spring 13. Free end 17 connects spring arms 14*a* and 14*b* to one another. The contact spring 13 extends opposite to insertion direction E in the direction of opening 9.

Figure 4:
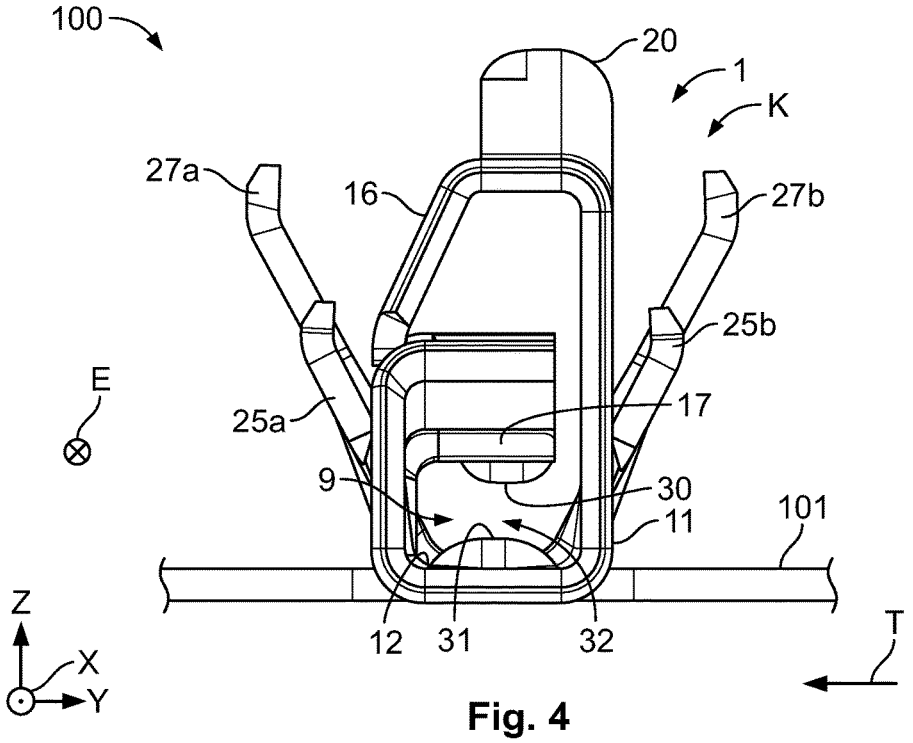
FIG. 4 is a front view of the carrier assembly of FIG. 2.

As shown in FIG. 4, a clamping region 30 of the contact 1 is formed at free end 17 of contact spring 13. The clamping region 30 projects downward and protrudes into a plug contact receptacle 32. The clamping region 30 is opposite a counter-clamping region 31 which projects from base 12 of contact 1 upward. Plug contact receptacle 32 is formed between clamping region 30 and counter-clamping region 31 and delimited laterally by side wall 11.

The case portion 7, as shown in FIG. 1, is fully enclosed by housing 16. A depression 19 for accommodating a catch spring 20 of contact 1 is formed in a ceiling region 18 of housing 16 in the case portion 7. Catch spring 20 extends opposite an introduction direction I and also extends substantially parallel with longitudinal axis L1 of contact 1 for introduction of contact 1 into a contact chamber of a plug connector (not shown). In a correct end position in the contact chamber, catch spring 20 latches and secures contact 1 in the contact chamber or supports it therein opposite to introduction direction I; plugging forces acting in insertion direction E, during introduction of a pin contact into contact 1, cannot move the contact 1 out of the contact chamber due to the latching of the catch spring 20.

In other embodiments, contact 1 has a further support at a rear side 21 of case portion 7, where further securing elements can engage behind contact 1 and prevent unintentional movement opposite to introduction direction I or in insertion direction E. Transition portion 3, disposed adjacent rear side 21 of the case portion 7 in the longitudinal direction L1 is configured so that any further securing elements can be brought into engagement with contact 1 in transverse direction Y and vertical direction Z here.

Crimp portion 4, as shown in FIG. 1, has a conductor crimp portion 22, a transition crimp portion 23 and an insulation crimp portion 24 which is connected via transition crimp portion 23 to conductor crimp portion 22.

Figure 3:
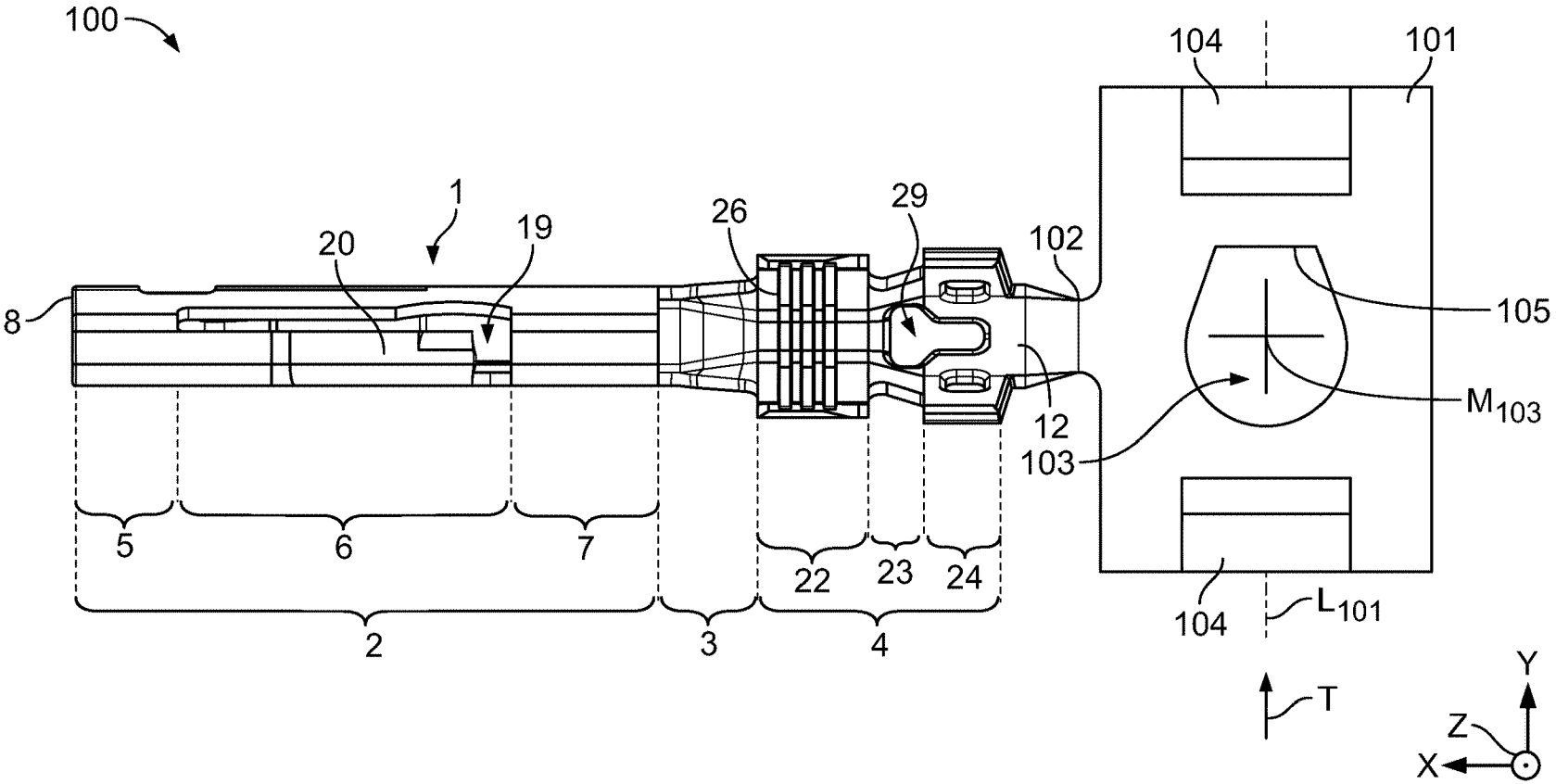
FIG. 3 is a top view of the carrier assembly of FIG. 2.

Conductor crimp portion 22, as shown in FIG. 1, has two conductor crimp flanks 25*a*, 25*b* which extend away from base 12 in vertical direction Z and are arranged opposite one another relative to longitudinal axis L1. On a side facing longitudinal axis L1, conductor crimp flanks 25*a*, 25*b* each have channels 26 extending transversely to longitudinal direction L1. As shown in FIG. 3, the channels 26 in conductor crimp portion 22 extend from conductor crimp flank 25*a* through base 12 and continuously into conductor crimp flank 25*b*.

Figure 5:
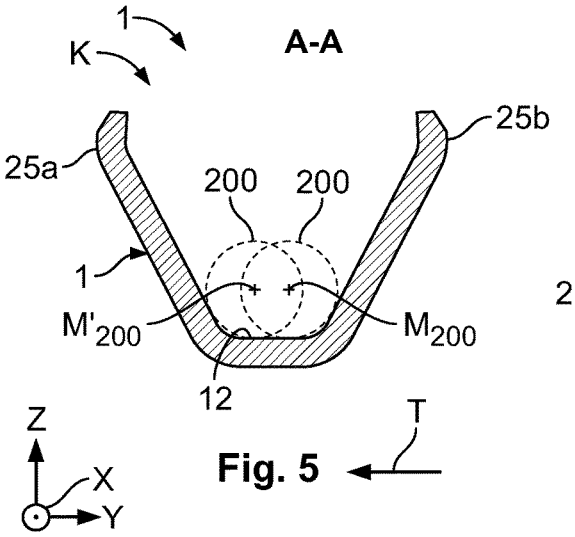
FIG. 5 is a sectional view of the contact taken along line A-A of FIG. 2.

As shown in FIG. 5, an electrical conductor 200 is inserted between the conductor crimp flanks 25*a*, 25*b*. The conductor 200 is placed on the base 12 of the contact 1 and is positioned in a range between two maximum positions of a center point M200, M'200 of the conductor 200 spaced apart in transverse direction Y. The channels 26 mechanically engage the conductor 200 during crimping, and because the channels 26 extend continuously through the conductor crimp flanks 25*a*, 25*b*, the channels 26 engage an entire outer circumference of the conductor 200.

Insulation crimp portion 24 has two insulation crimp flanks 27*a*, 27*b*, as shown in FIG. 1, which are arranged opposite one another relative to longitudinal axis L1 and extend from base 12. The insulation crimp flanks 27*a*, 27*b* engage an insulation of the electric conductor, as described in greater detail below. Conductor crimp flanks 25*a*, 25*b* and insulation crimp flanks 27*a*, 27*b*, as shown in FIG. 4, protrude in transverse direction Y to the left and right from housing 16 or its side walls 11. Insulation crimp recesses 28*a*, 28*b* receive insulation material of the electric conductor displaced during crimping and are formed in insulation crimp flanks 27*a*, 27*b* so as not to protrude over the outer contour of crimped insulation crimp flanks 27*a*, 27*b*, avoiding expanding outer dimensions of contact 1 in transverse direction Y and/or vertical direction Z. As shown in FIG. 3, crimp portion 4 has a base recess 29 which extends through the base 12 and from insulation crimp portion 24 into transition crimp portion 23.

Figure 6:
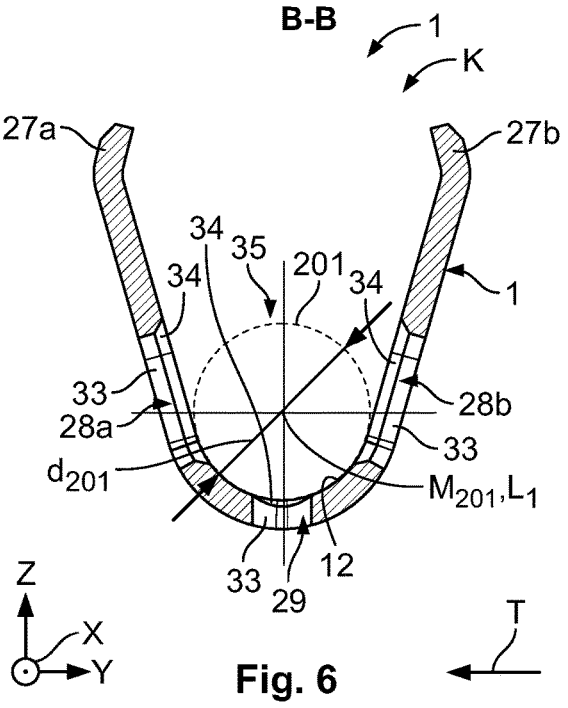
FIG. 6 is a sectional view of the contact taken along line B-B of FIG. 2.

As shown in FIG. 6, an insulation 201 of the electric conductor 200 is disposed with a center M201 on base 12 above base recess 29. An inner contour of conductor crimp flanks 27*a*, 27*b* and base 12 and the outer contour of insulation 201 are adapted to hold the insulation 201 in a predefined position prior to crimping of insulation crimp flanks 27*a*, 27*b*. Insulation crimp recesses 28*a*, 28*b* and base recess 29 are through-openings have a straight portion 33 and a funnel-shaped portion 34 which widens in the direction towards an insulation receptacle 35 of contact 1 formed between insulation crimp flanks 27*a*, 27*b* and base 12. Insulation 201 penetrates into recesses 28*a*, 28*b*, 29 during crimping of insulation crimp flanks 27*a*, 27*b* without excessive notching at the edges of recesses 28*a*, 28*b*, 29 along funnel-shaped portions 34 and has enough space along straight line portions 33 to expand to the outside without protruding beyond the outer contour of contact 1.

Figure 7:
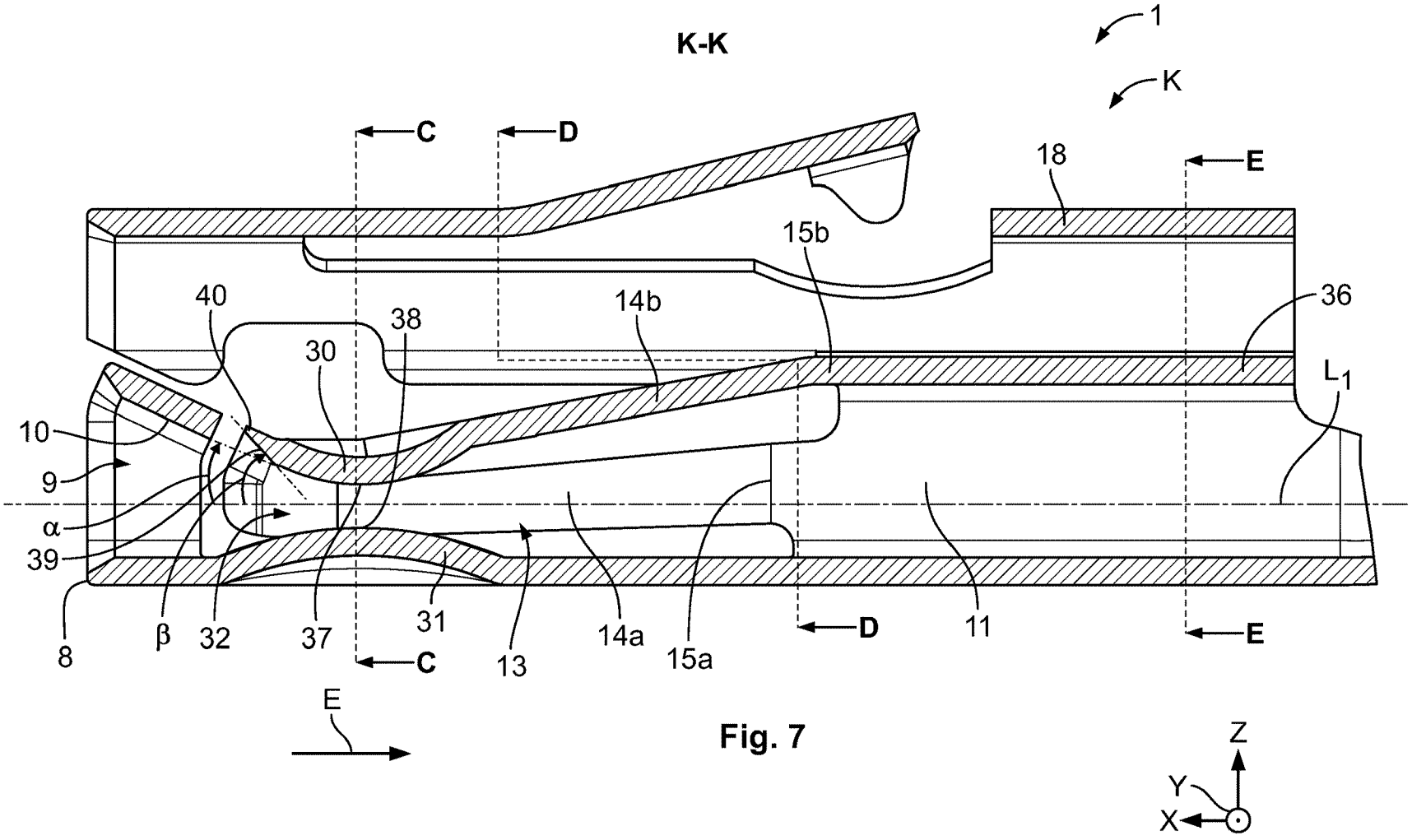
FIG. 7 is a sectional view of the contact taken along line K-K of FIG. 9.

As shown in FIG. 7, spring arm 14*a* of contact spring 13 is connected via its spring arm base 15*a* to side wall 11 of contact 1 and spring arm 14*b* is connected via its spring arm base 15*b* to an intermediate ceiling 36 of contact 1 which extends along entire case portion 7. Clamping region 30 and counter-clamping region 31 are arranged at the same height in insertion direction E; an apex 37 of clamping region 30 lies opposite an apex 38 of counter-clamping region 31 in a projection along transverse direction Y. Clamping region 30 and counter-clamping region 31 thus exert a contact force on a pin contact at apex 37 or counter-apex 38 as perpendicularly as possible to insertion direction E.

In order to guide the pin contact accurately into plug contact receptacle 32 and to avoid unplugging, insertion ramp 10 is directed towards a chamfer 39 at a ramp insertion angle □ to longitudinal axis L1, which chamfer 39 is formed on a front edge 40 of contact spring 13 pointing opposite to insertion direction E. A chamfer insertion angle □ is formed between chamfer 39 and longitudinal axis L1, which angle is greater than ramp insertion angle □ The lower end of insertion ramp 10 overlaps with front edge 40 in insertion direction E. It can thus be ensured that, even if the pin contact runs into insertion ramp 10 at ramp insertion angle □ obliquely in the direction towards plug receptacle 32 through opening 9 into plug portion 2, the pin contact is guided reliably onto clamping region 30 via chamfer 39.

Figure 10:
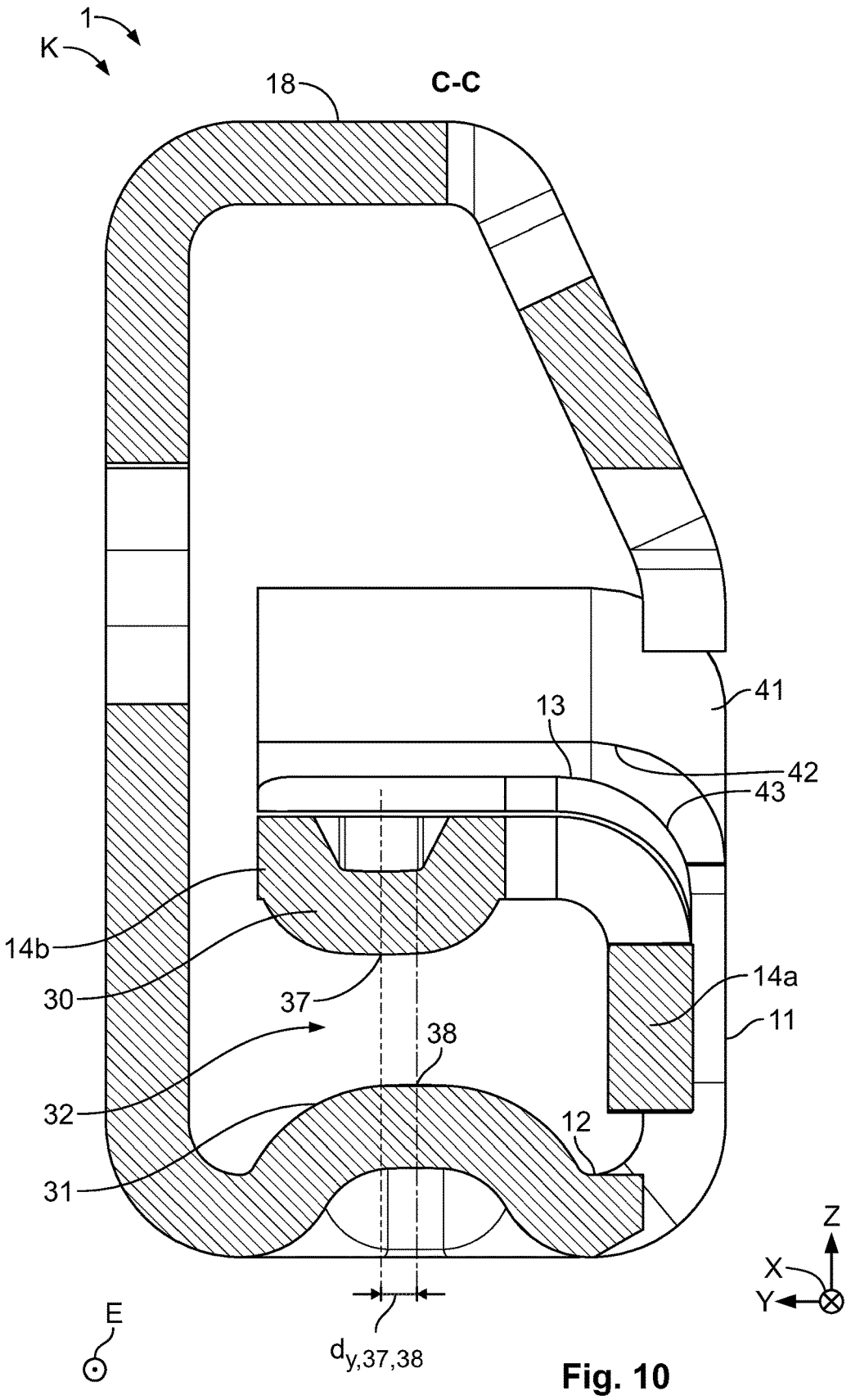
FIG. 10 is a sectional view of the contact taken along line C-C of FIG. 7

As shown in FIG. 10, apex 37 of clamping region 30, in an unplugged starting state of contact 1, is arranged in transverse direction Y with a spacing $d_{Y,37,38}$ from counter-apex 38 of counter-clamping region 31. In a plugging state in which the pin contact is received in plug contact receptacle 32, apex 37 and counter-apex 38 are substantially exactly opposite one another; spacing $d_{Y,37,38}$ between apex 37 and counter-apex 38 in transverse direction Y is largely minimized when the pin contact is received in plug contact receptacle 32. In order to also enable the movability of contact spring 13 in transverse direction Y as is required for this, spring arm 14*a* is arranged deflected or offset from side wall 11 inwards towards longitudinal axis L1 of contact 1. From its spring arm base 15*a*, spring arm 14*a* extends at a relatively acute angle to longitudinal axis L1 of contact 1. As a result, movability of contact spring 13 across the entire length of spring arms 14*a*, 14*b* from longitudinal axis L1 of contact 1 to the outside is ensured.

Figure 8:
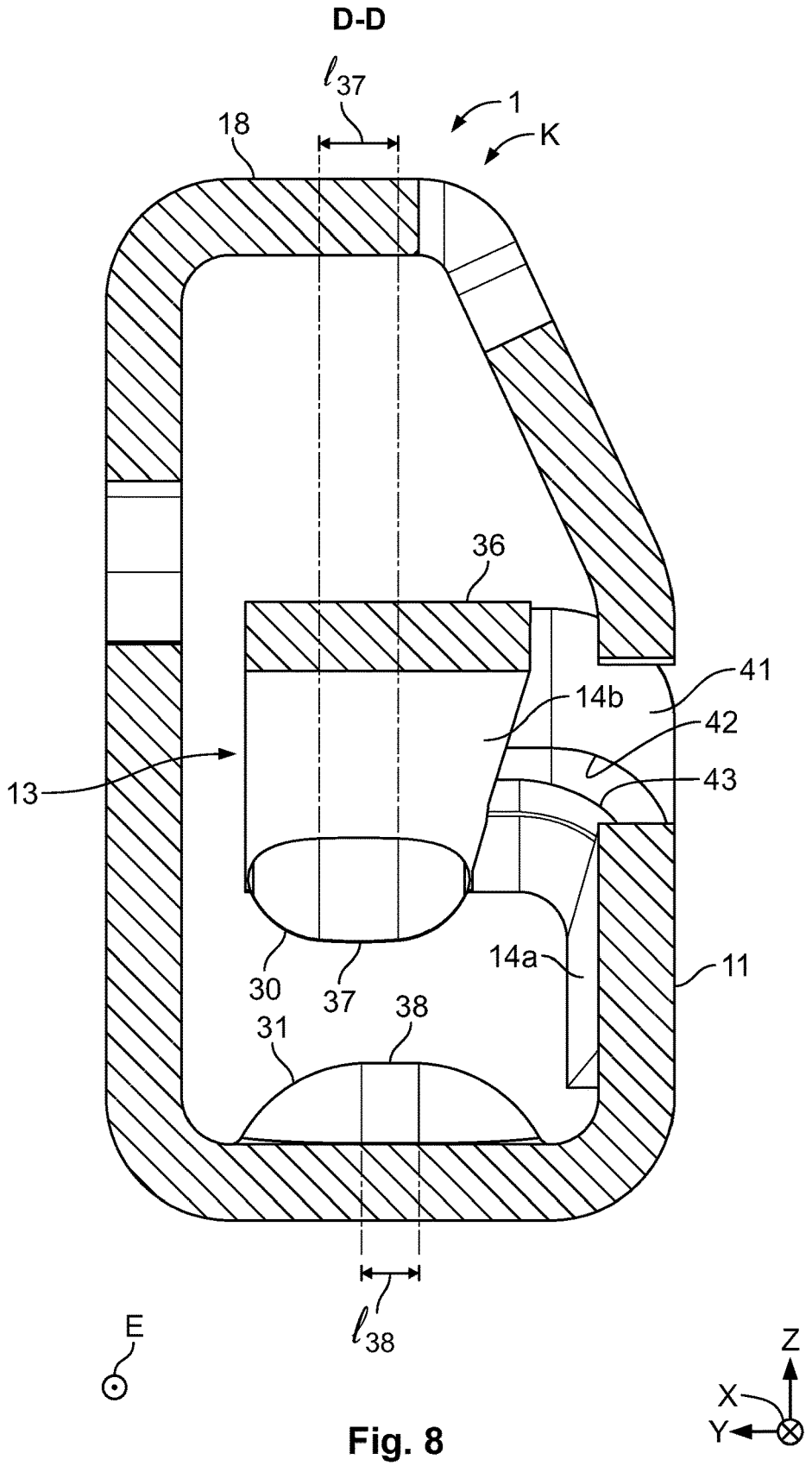
FIG. 8 is a sectional view of the contact taken along line D-D of FIG. 7.

Apex 37, as shown in FIG. 8, has a length $l_{37}$ parallel with transverse direction Y which is greater than a length $l_{38}$ of the counter-apex 38 parallel to transverse direction Y. This helps to ensure that apex 37 and counter-apex 38 always lie opposite and as parallel to one another as possible.

Figure 9:
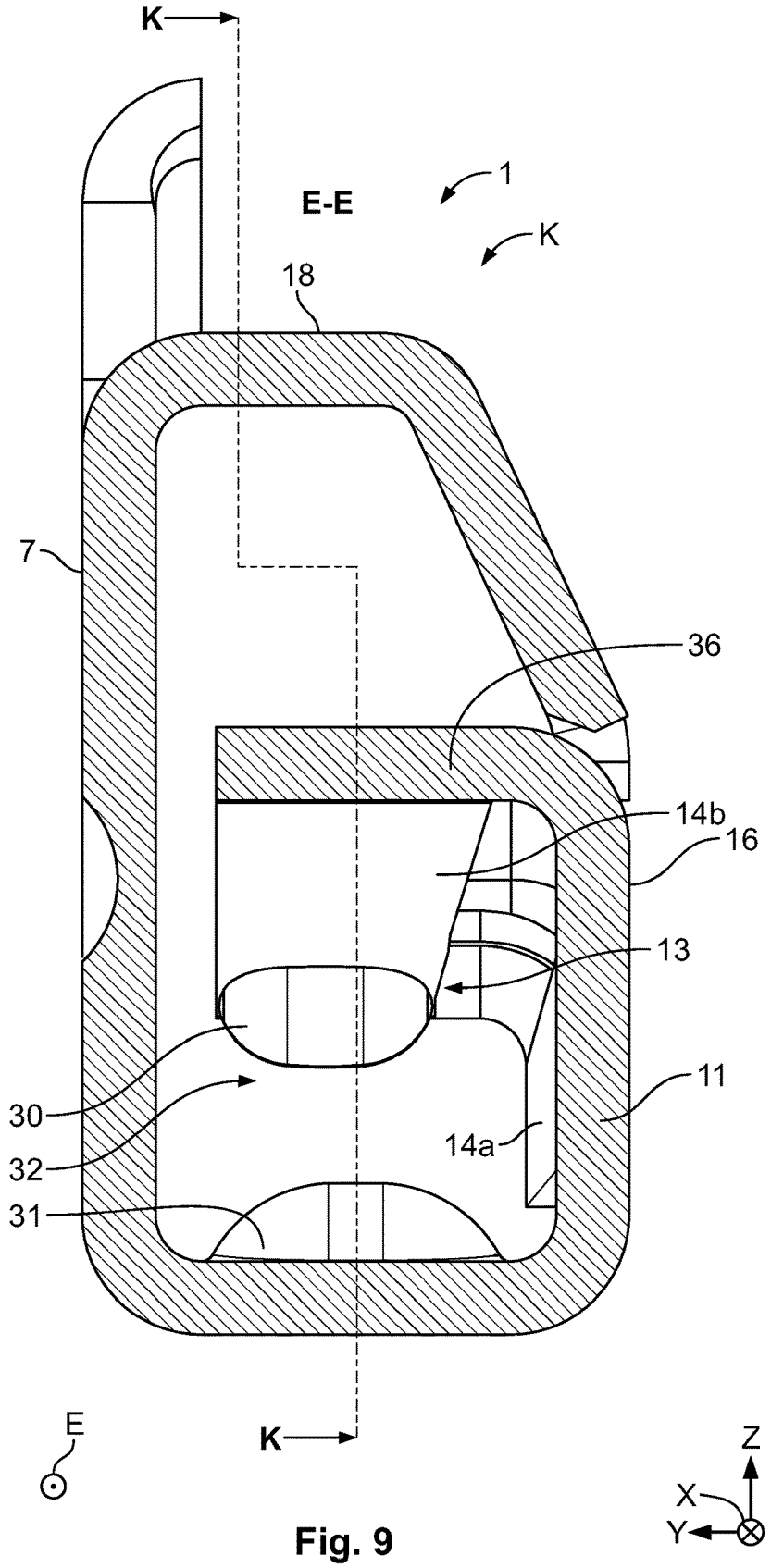
FIG. 9 is a sectional view of the contact taken along line E-E of FIG. 7.

Contact spring 13, as shown in FIGS. 8-10, has a substantially L-shaped cross-section along insertion direction E. Spring arm 14*a* forms the short limb and spring arm 14*b* the long limb of the L-shape. In order to avoid plastic deformation of contact spring 13, in particular of spring arm 14*a*, contact 1 has an overbending protection device 41. Overbending protection device 41 is formed as an inwardly bent portion of side wall 11 and has a delimiting contour 42 rounded in the direction towards contact spring 13. The delimiting contour 42 is complementary to a supporting contour 43 formed on contact spring 13. Contact spring 13 can thus be supported with its supporting contour 43 bearing as flat as possible against delimiting contour 42 in a state of maximum elastic deflection prior to yielding or plastic deformation of contact spring 13, particularly prior to yielding or deformation of the spring arms 14*a*, 14*b*.

Figure 2:
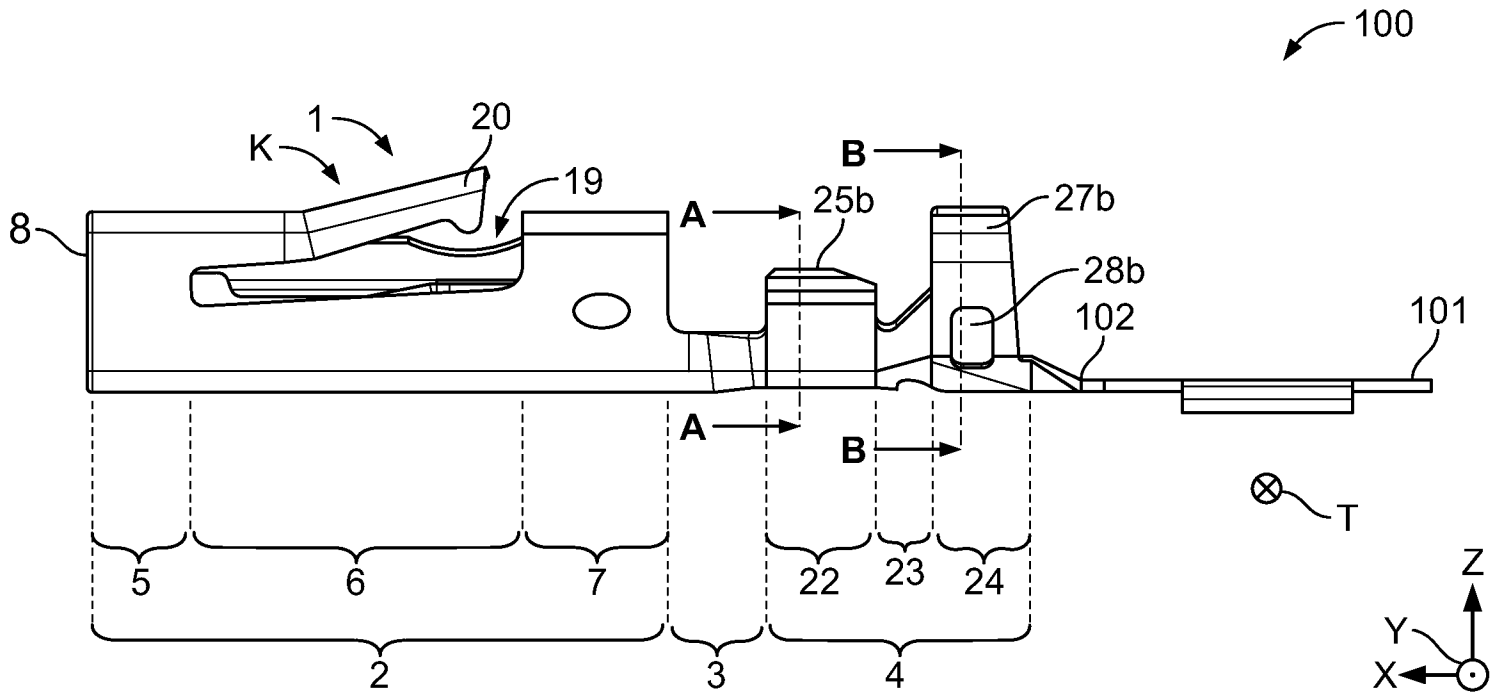
FIG. 2 is a side view of a carrier assembly according to the invention including the contact of FIG. 1.

A carrier assembly 100 according to the invention including at least one contact 1 fastened to a carrier strip 101 is shown FIGS. 2-4. As shown in FIG. 2, contact 1 is connected via a material bridge 102 to the carrier strip 101. In the shown embodiment, the contact 1, material bridge 102, and carrier strip 101 are monolithically formed; the carrier assembly 100 is punched from a single sheet.

The carrier strip 101, as shown in FIG. 3, has a longitudinal axis L101 extending substantially perpendicularly to longitudinal axis L1 of contact 1. Transport holes 103 and impressions 104 in carrier strip 101 are formed centrally along longitudinal axis L101 of carrier strip 101. A center point M103 of one of transport holes 103 lies in transverse direction Y at the same height as longitudinal axis L1 of contact 1.

Transport hole 103 has a drive edge 105 which extends substantially in a straight line transversely to longitudinal axis L101 of carrier strip 101. Drive edge 105, as shown in FIG. 3, extends perpendicular to a transport direction T of the carrier assembly 100, which extends substantially parallel with transverse direction Y. The drive edge 105 provides a transport pin (not shown) of an equipping device with a sufficiently large bearing surface so that the transport pin does not unintentionally deform transport hole 103 during driving of carrier assembly 100 in the transport direction T.

Figure 11:
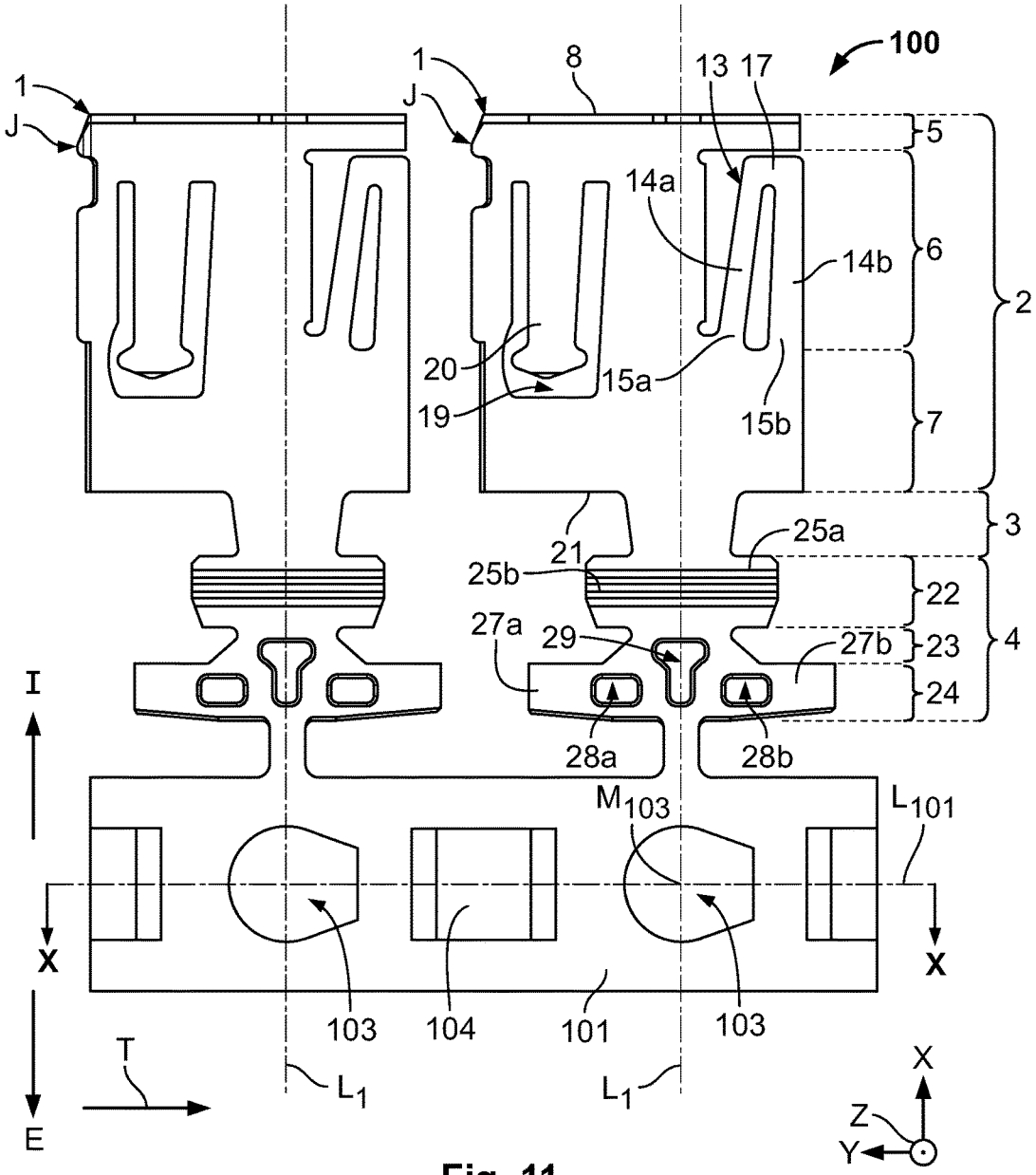
FIG. 11 is a top view of the carrier assembly of FIG. 2 in an unfolded state.
Figure 12:
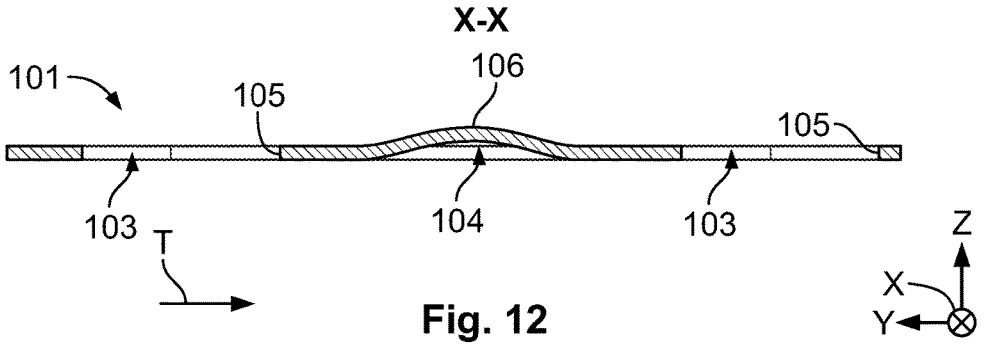
FIG. 12 is a sectional view of a carrier strip of the carrier assembly taken along line X-X of FIG. 11.

The carrier assembly 100 is shown in FIG. 11 in a punched, unfolded state J. In the embodiment shown in FIG. 11, the carrier assembly 100 has two contacts 1 joined to the carrier strip 101. As shown in FIG. 12, impression 104 has a rounded region 106 preventing a tilting of carrier strip 100 in a guide of an equipping device.

Deviations from the embodiments described with respect to FIGS. 1-12 above are possible within the scope of the invention. A carrier assembly 100 can comprise carrier strips 101 which can bear contacts 1 in any desired number. Contacts 1 can be provided with any of the described elements in any desired form and number in order to hold contacts 1 in contact chambers of a plug connector and to be able to securely contact a contact pin with application of desired contact forces with contact 1 in an electrically conductive manner. Carrier strip 101 can also have any of the described elements in any desired number depending on the respective requirements in order to supply at least one contact 1 reliably to an automatic placement machine or an equipping device and thus to be able to handle and/or process it.

Figure 13:
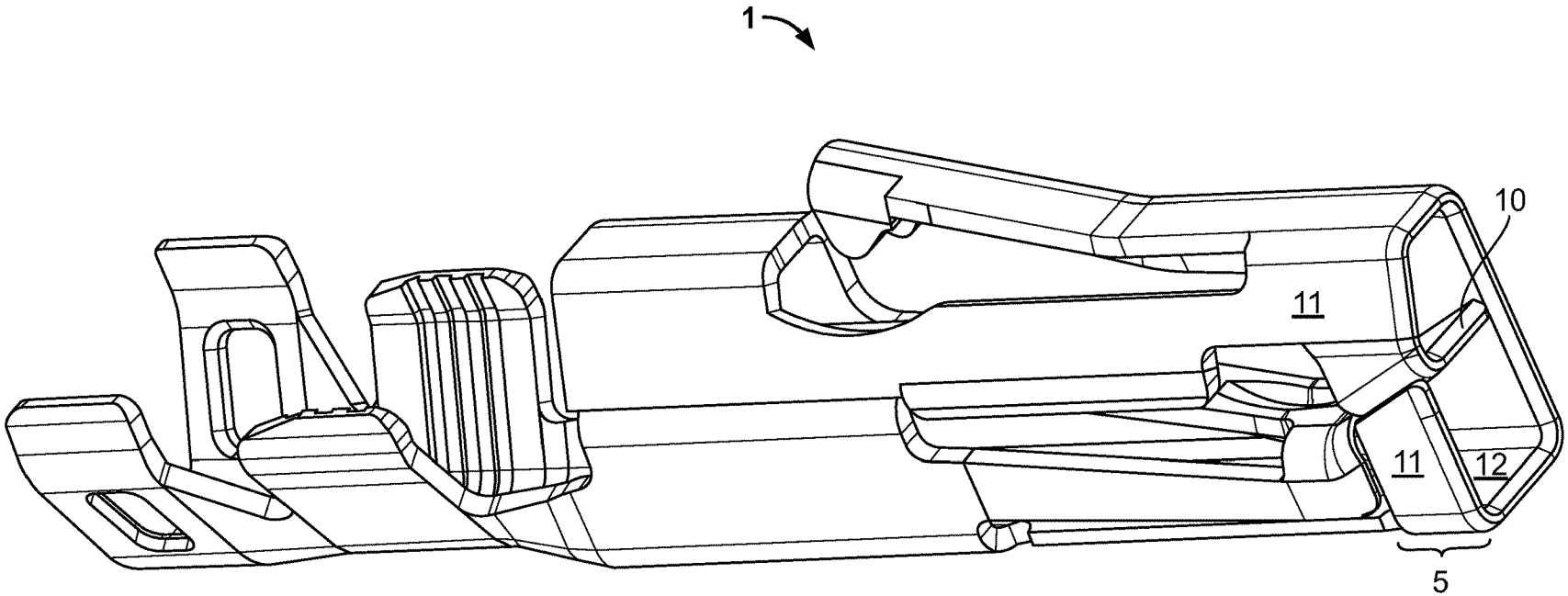
FIG. 13 is a perspective view of a contact according to another embodiment of the invention.

A contact 1' according to another embodiment of the invention is shown in FIG. 13. In contrast to the contact 1 of FIG. 1, the insertion ramp 10 is not joined to the lower part, but rather to the upper part of side wall 11.

Figure 15:
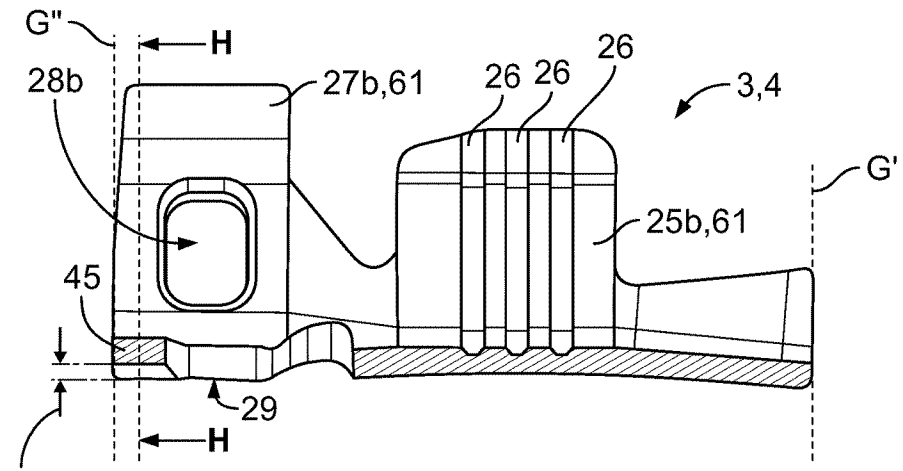
FIG. 15 is a sectional view of the contact of FIG. 14 taken along a longitudinal axis of the contact.
Figure 16:
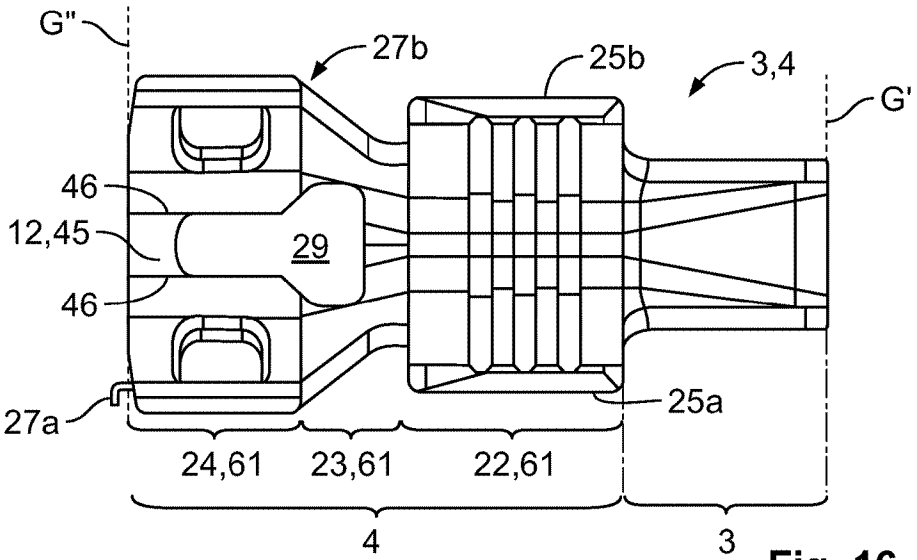
FIG. 16 is a top view of the contact of FIG. 14.
Figure 14:
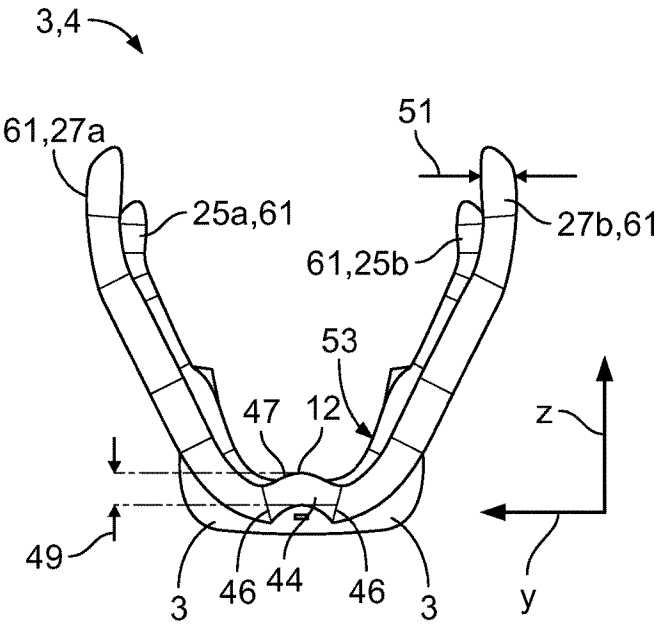
FIG. 14 is a sectional view of a contact according to another embodiment of the invention taken along a transverse axis of the contact.

A contact 1" according to another embodiment of the invention is shown in FIGS. 14-16. Only the transition portion 3 and the crimp portion 4 of the contact 1" are shown in FIGS. 14-16. The base 12 has an embossing 45 extending with a curved surface 47 into the vertical direction Z with an embossing height 49 which is approximately half of the material thickness 51 of the contact 1". The curved surface 47 has a curvature opposite to a flank curvature 53 of the crimp flanks 27*a*, 27*b*. The embossing 45 has two bending points 46 symmetrical along the Y-direction with respect to the highest point of the embossing 45. As shown in FIG. 15, the embossing 45 extends from the material bridge 102 to the base recess 29. As shown in FIG. 16, the portion of the base 12 having the embossing 45 is located between the isolation crimp flanks 27*a*, 27*b*.

Figure 17:
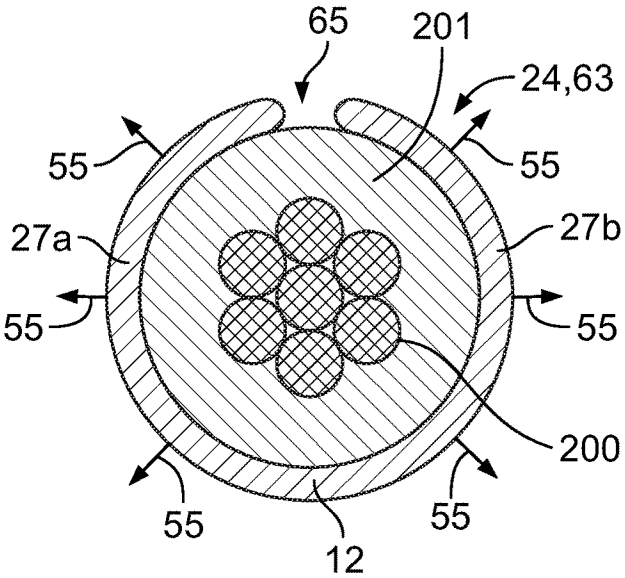
FIG. 17 is a sectional view of a crimped insulation crimp portion of a prior art contact taken along a transverse axis of the prior art contact.

FIGS. 1-6 and 13-16 show the crimp portions 22, 23, 24 in a pre-crimp state 61 in which the crimp flanks 25*a*, 25*b*, 27*a*, 27*b* are open and adapted to receive the conductor 200. A known contact in a final crimp state 63 is shown in FIG. 17, which shows the insulation crimp flanks 27*a* and 27*b*, the insulation 201, and the electric conductor 200. The elastic resilience of the insulation 201 exerts a flank force 55 on the two insulation crimp flanks 27*a* and 27*b* after crimping. The overall effect of the flank forces 55 is a tendency to re-opening crimped insulation crimp portion 24 which results in a gap 65 between the insulation crimp flanks 27*a*, 27*b*.

Figure 18:
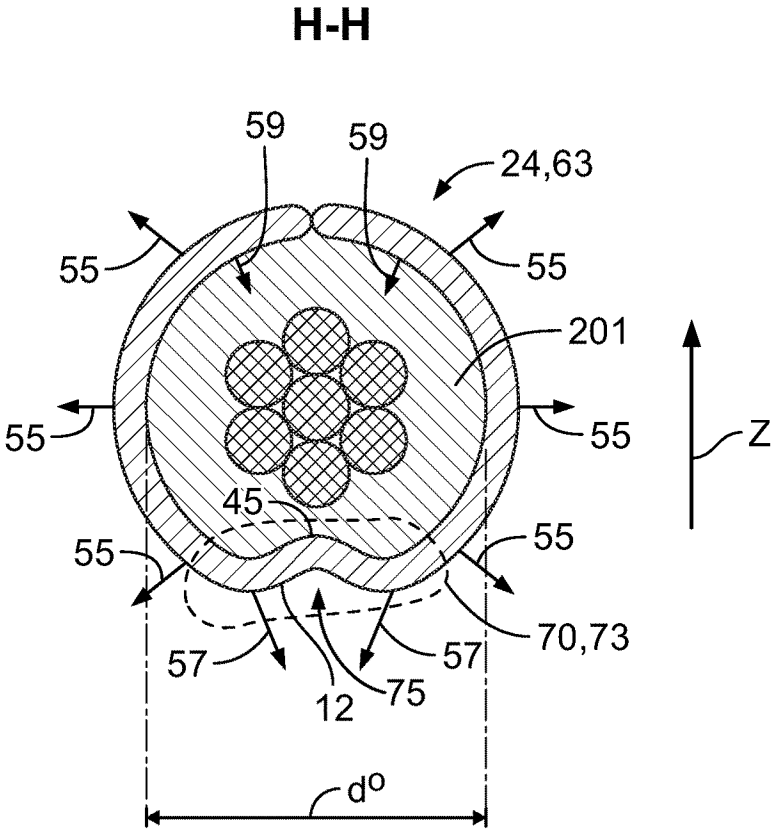
FIG. 18 is a sectional view of the contact of FIG. 14 in a crimped state taken along line H-H of FIG. 15.

The contact 1" is shown in a final crimp state 63 in FIG. 18. The embossing 45 is flattened after the crimping process and a resilient embossing force 57 results in the direction of the original curvature. The embossing force 57 is exerted to the insulation crimp flanks 27*a* and 27*b* at least in parts in a direction opposite to the vertical direction Z, therefore increasing an abutment force 59 between the insulation crimp flanks 27*a*, 27*b* and the insulation of the electric conductor 201. The embossing force 57 therefore at least partially compensates the flank forces 55 and the insulation crimp portion 24 does not have a gap 65. A deformation area 70 of the contact 1" has an increased plastic deformability with respect to the insulation crimp flanks 27*a*, 27*b*; the deformation area 70 is a weakened zone 73. The deformation area 70 has a spare volume 75 at least partly surrounded by the insulation crimp flanks 27*a*, 27*b*.

In the shown embodiment, the insulation 201 has a diameter d0. Insulations 201 with diameters d within the range (d−<d0<d+) may be received in between the insulation crimp flanks 27*a*, 27*b* without decreasing the reliability of the insulation crimp.

As shown in FIGS. 19A and 19B, the electric conductor 200 has an insulation 201 with an insulation diameter d+ which may be about approximately 15% larger than the insulation diameter d0 of the electric conductor 200 shown in FIG. 18. FIG. 19A shows the insulation crimp portion 24 in an intermediate crimp state 62 and FIG. 19B in the final crimp state 63. During crimping of any of the crimp portions 22, 23, 24, the intermediate crimp state 62 is reached prior to completion of the crimping process, that is, with respect to the temporal crimping progression, the intermediate crimp state 62 is reached after the pre-crimp state 61 and before the final crimp state 63. In the intermediate crimp state 62 of FIG. 19A, the insulation crimp flanks 27*a*, 27*b* abut the insulation 201, but the gap 65 remains between the insulation crimp flanks 27*a*, 27*b*.

Upon further application of the crimping force 67 which is pointing toward the center of the insulation crimp portion 24, as shown in FIG. 19A, the further compression of the insulation 201 exerts a deformation force 69. The deformation force 69 is exerted towards the deformation area 70 and deforms the embossing 45, that is, it flattens the embossing 45 and pushes the insulation crimp flanks 27*a*, 27*b* along a corresponding shift direction 71*a*, 71*b*. Bending, i.e. flattening of the embossing 45 is realized by bending the insulation crimp portion 24 at the predetermined bending points 46. An uncontrolled deformation or bending in other sections of the isolation crimp portion 24 is thus avoided by the predetermined bending points 46.

In the final crimp state 63 shown in FIG. 19B, the insulation crimp flanks 27*a*, 27*b* touch each other and close the insulation crimp. The embossing 45 is deformed such that neither the embossing 45 nor the predetermined bending points 46 are distinguishable. The spare volume 75 is reduced to zero. The embossing 45 may therefore be regarded as a reservoir for adapting to larger diameters up to the diameter d+, still maintaining a reliable insulation crimp.

As shown in FIGS. 20A and 20B, the electric conductor 200 has an insulation 201 with a diameter d− received in between the insulation crimp flanks 27*a*, 27*b*. In the intermediate crimp state 62 shown in FIG. 20A, insulation crimp flanks 27*a*, 27*b* are crimped such that they abut each other yielding an inner diameter of approximately d0 which results in the gap 65 being located in between the insulation crimp flanks 27*a*, 27*b* and the insulation 201. The deformation area 70 is at least partly surrounded by the insulation crimp flanks 27*a*, 27*b*. The spare volume 75 is also located in the deformation area 70. Further exertion of the crimping force 67 will not result in moving the insulation crimp flanks 27*a*, 27*b* closer to each other, as they already abut each other.

The deformation force 69, contrarily to the situation of FIG. 19A, is exerted towards the deformation area 70, in particular towards the embossing 45 which is moved further into the space between the insulation crimp flanks 27*a*, 27*b*. This movement is provided by bending the insulation crimp portion 24 at the predetermined bending points 46 which avoid uncontrolled bending in different sections of the isolation crimp portion 24, as shown in the final crimp state 63 in FIG. 20B. In the final crimp state 63, the inner diameter of the insulation crimp portion 24 is reduced from d0 to approximately d−, which is the diameter of the insulation of the electric conductor 201. In FIG. 20B, the embossing 45 as well as the predetermined bending points 46 remain visible. In the final crimp state 63, the embossing height 49 and the spare volume 75 are increased compared to the intermediate crimp state 62 shown in FIG. 20A.

What is claimed is:

1. A contact for an electrical plug connector, comprising:

a plug portion having an opening receiving a pin contact in an insertion direction and a counter-clamping region; and a contact spring having at least two spring arms which jointly support a free end of the contact spring, a clamping region positioned opposite the counter clamping region and laterally offset relative to the counter-clamping region prior to pin contact insertion, and being connected by at least one spring arm base to the plug portion and extending from the at least one spring arm base toward the opening in a direction opposite the insertion direction, the contact spring exerting a contact force on the pin contact perpendicular to the insertion direction.

2. The contact of claim 1, wherein the contact spring is at least partially L-shaped in the insertion direction.

3. The contact of claim 1, wherein a first spring arm of the at least two spring arms is connected to a side wall of the plug portion and a second spring arm of the at least two spring arms is connected to a ceiling of the plug portion.

4. The contact of claim 1, further comprising an overbending protection device extending transverse to the insertion direction, the overbending protection device preventing deflection of the contact spring beyond a maximum elastic deflection.

5. The contact of claim 1, wherein the plug portion has an insertion ramp formed in a region of the opening, spaced apart from a front edge of the contact spring, and extending obliquely relative to the insertion direction.

6. The contact of claim 5, wherein the insertion ramp extends toward a chamfer formed on a front edge of the contact spring.

7. The contact of claim 6, wherein a ramp insertion angle between the insertion ramp and a longitudinal axis of the contact is smaller than a chamfer insertion angle between the chamfer and the longitudinal axis.

8. The contact of claim 1, further comprising an insulation crimp portion having a recess fixing an insulation of an electric conductor to the contact.

9. The contact of claim 8, wherein the recess is an insulation crimp recess disposed in an insulation crimp flank of the insulation crimp portion.

10. The contact of claim 9, wherein the insulation crimp recess is a through-opening extending through the insulation crimp flank.

11. The contact of claim 8, wherein the recess is a base recess formed in a base of the contact.

12. The contact of claim 11, wherein the base recess extends from the insulation crimp portion at least into a transition crimp portion, the transition crimp portion connecting the insulation crimp portion to a conductor crimp portion of the contact.

13. A carrier assembly for equipping electrical plug connectors with contacts, comprising:

a contact including; a plug portion having an opening receiving a pin contact in an insertion direction and a laterally offset counter-clamping region; and a contact spring having at least two spring arms which jointly support a free end of the contact spring, a clamping region positioned opposite the counter-clamping region, and being connected by at least one spring arm base to the plug portion, the contact spring extending from the at least one spring arm base toward the opening in a direction opposite the insertion direction and exerting a contact force on the pin contact perpendicular to the insertion direction, and a carrier strip fastened to the contact.

14. The carrier assembly of claim 13, wherein the carrier strip includes a transport hole having a drive edge extending transversely to a longitudinal axis of the carrier strip, a transport pin engaging the drive edge to drive the carrier strip.

15. The carrier assembly of claim 13, wherein the carrier strip includes an impression having a rounded region.

16. A contact for an electrical plug connector, comprising:

a plug portion having an opening receiving a pin contact in an insertion direction, a counter-clamping region, and an insertion ramp formed in a region of the opening and extending obliquely relative to the insertion direction; and a contact spring having a clamping region positioned opposite the counter clamping region laterally offset relative to the counter-clamping region prior to pin contact insertion and being connected by at least one spring arm base to the plug portion and extending from the at least one spring arm base toward the opening in a direction opposite the insertion direction, the contact spring exerting a contact force on the pin contact perpendicular to the insertion direction, the insertion ramp is spaced apart from a front edge of the contact spring and extends toward a chamfer formed on the front edge of the contact spring.

17. The contact of claim 16, wherein a ramp insertion angle between the insertion ramp and a longitudinal axis of the contact is smaller than a chamfer insertion angle between the chamfer and the longitudinal axis.

* * * * *